US007287514B2

(12) United States Patent
Kakinuma et al.

(10) Patent No.: US 7,287,514 B2
(45) Date of Patent: Oct. 30, 2007

(54) FUEL SUPPLY CONTROL METHOD AND APPARATUS OF INTERNAL COMBUSTION ENGINE

(75) Inventors: Masao Kakinuma, Kanagawa-ken (JP); Tsutomu Murakami, Kanagawa-ken (JP)

(73) Assignee: Nikki Co., Ltd., Atsugi (JP)

( * ) Notice: Subject to any disclaimer, the term of this patent is extended or adjusted under 35 U.S.C. 154(b) by 0 days.

(21) Appl. No.: 11/305,194

(22) Filed: Dec. 19, 2005

(65) Prior Publication Data

US 2007/0012296 A1 Jan. 18, 2007

(30) Foreign Application Priority Data

Jul. 19, 2005 (JP) ..... 2005-207949

(51) Int. Cl.
*F02M 51/00* (2006.01)
*F02D 41/10* (2006.01)
*F02M 69/28* (2006.01)

(52) U.S. Cl. ..... 123/492; 123/436

(58) Field of Classification Search ..... 123/299, 123/300, 305, 436, 481, 492
See application file for complete search history.

(56) References Cited

U.S. PATENT DOCUMENTS 5,094,209 A * 3/1992 Kishida et al. ..... 123/406.46
6,453,874 B1 * 9/2002 Duffy et al. ..... 123/446
6,832,596 B2 * 12/2004 Watanabe et al. ..... 123/333
6,934,623 B2 * 8/2005 Nakamura et al. ..... 701/115
7,025,047 B2 * 4/2006 Leman et al. ..... 123/486
2006/0207557 A1 * 9/2006 Ito et al. ..... 123/431

FOREIGN PATENT DOCUMENTS

| | | | |
|---|---|---|---|
| JP | 60-53644 | * | 3/1985 |
| JP | 125748 | * | 7/1985 |
| JP | 63-008296 | | 1/1988 |
| JP | 64-24136 | * | 1/1989 |
| JP | 03-043640 | | 2/1991 |
| JP | 182669 | * | 8/1991 |
| JP | 5-99036 | * | 4/1993 |
| JP | 06-272601 | | 9/1994 |
| JP | 09-203335 | | 8/1997 |
| JP | 2002-004992 | | 1/2002 |
| JP | 2005-291173 | * | 10/2005 |
| JP | 2005-337148 | * | 12/2005 |

* cited by examiner

*Primary Examiner*—Hai Huynh
(74) *Attorney, Agent, or Firm*—Rader, Fishman & Grauer PLLC

(57) ABSTRACT

The invention provides a fuel supply control method and apparatus in which an air fuel ratio does not become rich even if an acceleration and deceleration operation is repeated for a short time in the case that a time lag with respect to a response from a detection of an acceleration state to a fuel amount increase is large, and troubles such as a black smoke generation from an exhaust pipe, an engine stop and the like are not generated. In a fuel supply control method of an internal combustion chamber for increasing an amount of a fuel for acceleration so as to inject from an injection apparatus, at a time of detecting a transient state at an accelerating time or the like on the basis of data such as an opening degree of a throttle valve and/or an air suction pressure, the method inhibits the fuel amount increase for acceleration on the basis of the detection of the transient state, if a total amount of an injection fuel per a unit time is more than a fixed value.

3 Claims, 2 Drawing Sheets

FUEL SUPPLY CONTROL METHOD AND APPARATUS OF INTERNAL COMBUSTION ENGINE

BACKGROUND OF THE INVENTION

1. Field of the Invention

The present invention relates to a fuel supply control method of an internal combustion engine used in a motor vehicle or the like, and more particularly to a fuel supply control method and apparatus which executes a control for increasing an amount of fuel in a transient state such as an accelerating time or the like.

2. Description of the Related Art

In conventional, in the case of supplying the fuel to the internal combustion engine by using an injection apparatus, an improvement of a power performance of an internal combustion engine, an exhaust gas purification, an improvement of a fuel consumption, an improvement of a drivability and the like are intended by controlling an injection amount of the fuel from the injection apparatus by an electronic control unit (ECU) so as to set a rate with a concentration of an air-fuel mixture between a fuel and a fuel supplied into a cylinder (a so-called an air-fuel ratio) to a predetermined value.

Further, the injection amount of the fuel can be theoretically calculated, however, since a preferable injection amount does not coincide with a theoretical value in some operating condition in an actual internal combustion engine, an appropriate control is executed by detecting actual measurement values from various sensors placed at necessary positions so as to compensate the theoretical value.

Further, in the fuel supply control method, a compensation control is necessary due to a displacement between a timing for detecting a throttle valve opening degree and a time required for computing a target injection time. As one of the compensation controls, for example, there is generally executed a fuel supply control method of increasing an amount of the fuel in a transient state such as an accelerating time or the like so as to increase an output of the internal combustion engine, which is proposed, for example, in Japanese Patent Publication No. 63-8296, Japanese Unexamined Patent Publication No. 3-43640, Japanese Unexamined Patent Publication No. 6-272601, Japanese Unexamined Patent Publication No. 2002-4992 and the like.

However, when executing the fuel amount increasing control which has been conventionally known, for example, in the case that a distance between an injection apparatus supplying the fuel and a combustion chamber of the internal combustion engine is long, a time lag with respect to a response from a detection of an acceleration state to the fuel amount increase is large. Accordingly, if a deceleration is executed just after an acceleration (hereinafter, refer to as "acceleration and deceleration operation"), the fuel enters into the combustion chamber more than necessary, in particular, if the acceleration operation is continuously executed for a short time, there is generated a phenomenon that the air fuel ratio becomes rich, so that there is generated troubles such as a black smoke generation from an exhaust pipe, an engine stop and the like.

Further, Japanese Unexamined Patent Publication No. 9-203335 proposes a fuel amount increase control means for preventing the air fuel ratio from becoming rich by storing a matter that a fuel amount increase control is executed at a time of an acceleration operation in an electronic control unit, thereafter not deleting the memory until a throttle valve opening degree is returned to a predetermined low position, and inhibiting the fuel amount increase control even if the throttle valve opening degree becomes in a transient state due to the acceleration until returning to the predetermined low position.

However, in the fuel amount increase control means proposed in Japanese Unexamined Patent Publication No. 9-203335, the fuel amount increase control is executed at a time when the throttle valve is opened at the accelerating time, and it is unavoidable that the fuel enters into the combustion chamber more than necessary if the acceleration and deceleration operation is executed in the case that the distance between the injection valve supplying the fuel and the combustion chamber is long.

Further, since the throttle valve opening degree is returned to the predetermined low position, whereby the memory is deleted and the inhibition of the fuel amount increase is cancelled, the fuel amount increase is continuously executed in the case that the acceleration and deceleration operation is repeated at two or more times for a short period.

SUMMARY OF THE INVENTION

The present invention is provided for the purpose of solving the following problems. In accordance with the present invention, there is provided a fuel supply control method and apparatus in which an air fuel ratio does not become rich even if an acceleration and deceleration operation is repeated for a short time, for example, in the case that a distance between an injection valve supplying a fuel and a combustion chamber is long and a time lag with respect to a response from a detection of an acceleration state to a fuel amount increase is large, and there is no risk that troubles such as a black smoke generation from an exhaust pipe, an engine stop and the like are generated, at a time of executing various fuel amount increase controls.

In order to solve the problem mentioned above, in accordance with the present invention, there is provided a fuel supply control method of an internal combustion chamber for increasing an amount of a fuel for acceleration so as to inject from an injection apparatus, at a time when an electronic control unit detects a transient state at an accelerating time or the like on the basis of data such as an opening degree of a throttle valve and/or an air suction pressure, wherein the method comprises a step of inhibiting the fuel amount increase for acceleration on the basis of the detection of the transient state, if a total amount of an injection fuel per a unit time is more than a fixed value.

Further, there is provided a fuel supply control apparatus of an internal combustion engine comprising:

an electronic control unit sending a control signal to a fuel injection apparatus supplying a fuel to the internal combustion engine;

a sensor for detecting a transient state such as an accelerating time or the like, such as a throttle valve opening degree sensor, an air suction pressure sensor or the like; and the fuel supply control apparatus increasing an amount of the fuel at the accelerating time on the basis of a signal from the sensor so as to supply the fuel from a fuel injection apparatus to the internal combustion engine, wherein the electronic control unit inhibits the fuel amount increase for acceleration from the fuel injection apparatus in the case that a total amount of the injection fuel per a unit time supplied to the internal combustion engine from the fuel injection apparatus is more than a fixed value.

In accordance with the present invention, in the fuel supply control method of the internal combustion chamber for increasing the amount of the fuel for acceleration so as to inject from the injection apparatus, at a time when the electronic control unit detects the transient state at the accelerating time or the like on the basis of the data such as the opening degree of the throttle valve and/or an engine load (the air suction pressure), the method inhibits the fuel amount increase for acceleration, if the total amount of the injection fuel per the unit time is more than the fixed value.

Further, in accordance with the fuel supply control apparatus corresponding to the present invention, in the fuel supply control apparatus of the internal combustion engine having the electronic control unit, the injection apparatus supplying the fuel to the internal combustion engine on the basis of the control signal from the electronic control unit, and the sensor for detecting the transient state such as the accelerating time or the like, such as the throttle valve opening degree sensor, the engine load (air suction pressure) sensor or the like, and increasing the amount of the fuel supplied from the fuel injection apparatus to the internal combustion engine in the electronic control unit on the basis of the signal from the sensor, the electronic control unit inhibits the fuel amount increase for acceleration in the case that the total amount of the injection fuel per the unit time supplied to the internal combustion engine from the fuel injection apparatus is more than a fixed value.

In accordance with the present invention, the fuel is not supplied more than necessary in the transient state such as the accelerating time or the like, the air fuel ratio does not become rich even if the acceleration and deceleration operation is repeated for a short time, and there is no risk that the trouble such as the black smoke generation from the exhaust pipe, the engine stop or the like is generated.

DESCRIPTION OF THE PREFERRED EMBODIMENTS

Figure 1:
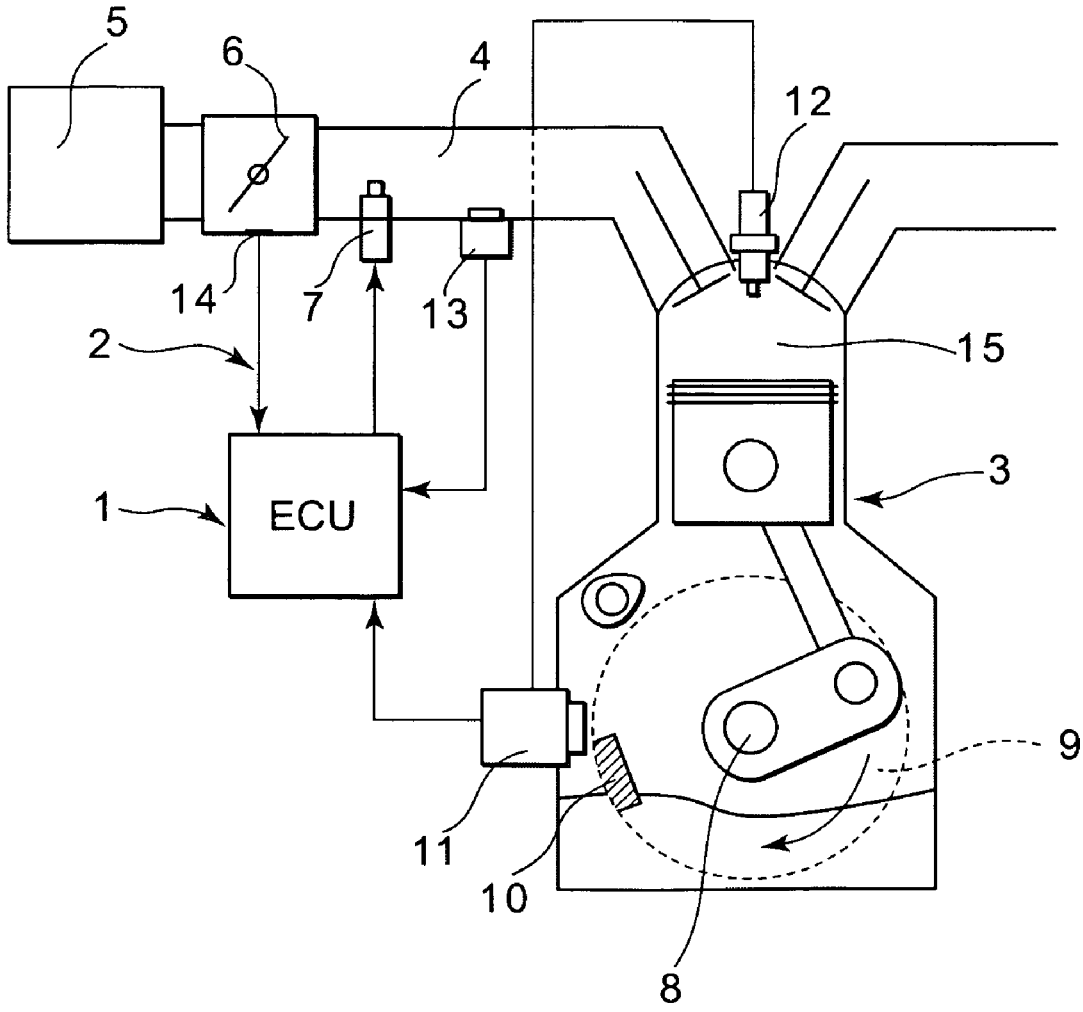
FIG. 1 is a layout view showing an embodiment in accordance with the present invention.

FIG. 1 shows a summary of a fuel supply control apparatus 2 for executing a fuel supply control method corresponding to the present invention in the case that the fuel supply control apparatus 2 is installed, for example, to a one-cylinder four-stroke internal combustion engine 3. An electronic control unit (ECU) 1 has a central processing unit (CPU), various memory devices (ROM, RAM and the like), a program and the like which are not illustrated, an air suction pipe 4 in the fuel supply control apparatus 2 is provided with an air cleaner 5 in an inlet, a throttle valve 6 is arranged in a downstream side thereof, and a fuel injection valve 7 is provided in a further downstream side.

Further, the structure is made such that the internal combustion engine 3 is structured such that a magnet 10 is additionally provided at a predetermined position in a peripheral edge of a flywheel 9 attached to a crank shaft 8, an ignition coil 11 is arranged close thereto, and a secondary voltage generated in a secondary coil of the ignition coil 11 generates a spark in an ignition coil 12 via the electronic control unit (ECU) 1 on the basis of a rotation of the crank shaft 8.

Further, an engine load (air suction pressure) sensor 13 continuously detecting an air suction manifold pressure is arranged in the air suction pipe 4 and a throttle valve opening degree sensor 14 is arranged near the throttle valve 6 so as to be respectively connected to the electronic control unit (ECU) 1, and a necessary fuel is sequentially calculated by the electronic control unit (ECU) 1 on the basis of signals from the various sensors such as the engine load (air suction pressure) sensor 13, the throttle valve opening degree sensor 14 and the like so as to be injected and supplied to a combustion chamber 15 of the internal combustion engine 3 from the fuel injection valve 7.

Figure 2:
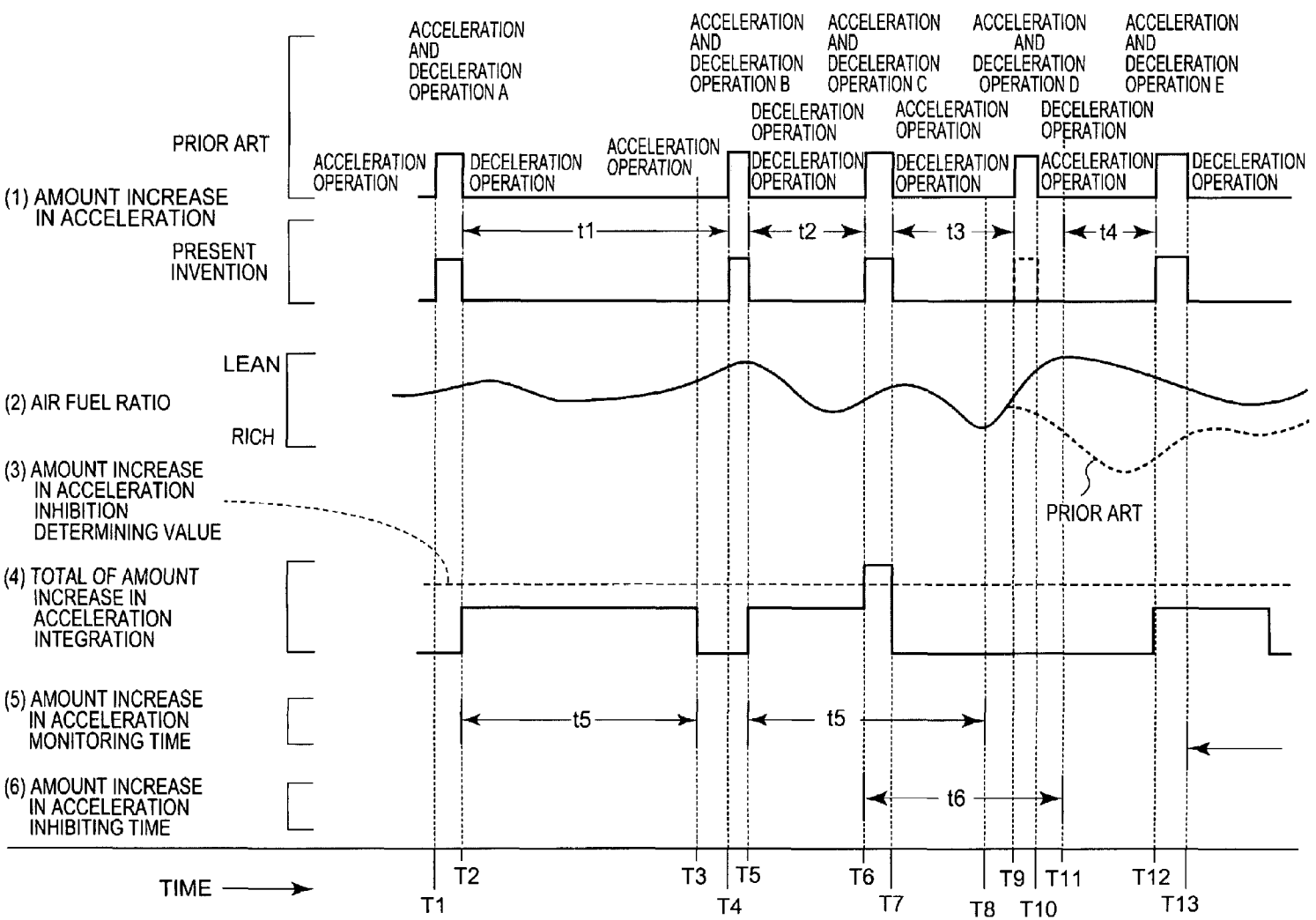
FIG. 2 is an explanatory view showing a preferable control method in accordance with the present invention with time.

Next, a description will be in detail given of a control method in accordance with the present embodiment in comparison with the conventional control method with reference to FIG. 2.

FIG. 2 shows changes of an acceleration increase amount, an air fuel ratio and the like and contents of a fuel amount increase control of the present invention and the prior art in the case of repeating an acceleration and deceleration operation A (times T1 to T2), B (times T4 to T5), C (times T6 to T7), D (times T9 to T10), E (times T12 to T13) and the like at plural times at a time of an operation. In accordance with the present embodiment, as mentioned above, the necessary amount of fuel which is calculated in the electronic control unit (ECU) 1 on the basis of the signals from the various sensors such as the engine load (air suction pressure) sensor 13, the throttle valve opening degree sensor 14 and the like shown in FIG. 1 in the same manner as the conventionally well-known structure is supplied from the fuel injection valve 7, whereby the internal combustion engine 3 is operated.

Further, when a driver operates an accelerator (not shown) so as to accelerate at a normal driving time, the electronic control unit (ECU) receiving an acceleration signal from the various sensors such as the engine load (air intake pressure) sensor 13, the throttle valve opening degree sensor 14 and the like shown in FIG. 1 supplies the fuel the amount of which is increased in correspondence to the acceleration, from the fuel injection valve 7, thereby increasing an output of the internal combustion engine 1. Next, when the deceleration operation is executed by returning the accelerator (not shown), the increase of the fuel amount is stopped.

The amount of the fuel is basically increased at a necessary amount so as to be injected every time when the acceleration and deceleration operation is executed (refer to an item (1) amount increase by acceleration shown in FIG. 2). For example, in the case that a time t1 to the acceleration operation time T3 of the acceleration and deceleration operation B after the deceleration operation time T2 about the continuous acceleration and deceleration operation A shown in FIG. 2 is over a time required until the increased amount of fuel supplied behind the acceleration operation in the beginning acceleration and deceleration operation A is consumed, the fuel to be increased behind the acceleration operation is not accumulated. Accordingly, even if the acceleration and deceleration operation B is continuously executed, a part in which the air fuel ratio becomes rich is cancelled as shown in an item (2) air fuel ratio shown in FIG. 2, and the fuel amount is returned to an original proper amount.

Accordingly, in the case that the time t1 to the acceleration operation time T4 of the acceleration and deceleration operation B after the deceleration operation time T2 in the continuous acceleration and deceleration operation A is over a time ((5) amount increase in acceleration monitoring time in FIG. 2 mentioned below) required until the increased amount of fuel supplied behind the acceleration operation in the acceleration and deceleration operation A is consumed, that is, the time t1 to the acceleration operation time T4 of the acceleration and deceleration operation B after the deceleration operation time T2 in the previous acceleration and deceleration operation A is not affected by the fuel amount increase accompanying with the acceleration operation by now, it is preferable to execute the same control as the conventional control.

In the present embodiment, as shown in FIG. 2, the method monitors the time t1 to the acceleration operation time T4 in the next acceleration and deceleration operation B from the deceleration operation time T2 in the beginning acceleration and deceleration operation A, and determines whether or not the time t1 is over the time t5 (the amount increase in acceleration monitoring time) to the time T8 when the influence by the fuel amount increase at the deceleration operation time in the acceleration and deceleration operation A from the deceleration operation time T2 in the deceleration operation A is cancelled. In the case that the time t1 is over the amount increase in acceleration monitoring time t5 as shown in FIG. 2, it is sufficient to execute the same amount increase control as the conventional structure.

In this case, the amount increase in acceleration monitoring time t5 is not continuously measured, but is reset after being measured once, and is again measured from a time point when the deceleration operation in the next acceleration and deceleration operation is executed.

In the case that the acceleration and deceleration operation C is executed following the acceleration and deceleration operation B shown in FIG. 2, there is a case that the time t2 to the acceleration operation time T6 of the next acceleration and deceleration operation C from the deceleration operation time T5 in the acceleration and deceleration operation B is not over the amount increase in acceleration monitoring time t4. In this case, there has been yet left the influence of the increased fuel at the acceleration operation time T6 of the acceleration and deceleration operation C. If the acceleration and deceleration operation C is further executed in addition thereto, there is a risk that the influence caused by the fuel amount increase is further strengthened.

Accordingly, in the case the amount increase in acceleration per the unit time about the amount increase in acceleration monitoring time t4 is integrated so as to calculate the total of (3) amount increase in acceleration integration shown in FIG. 2, and this value is over the value of the amount increase in acceleration per the unit time which is deemed not to be affected by a previously determined fuel amount increase at a time of the deceleration operation ((6) amount increase in acceleration inhibition determining value shown in FIG. 2), the increase amount in acceleration is inhibited for a fixed time, that is, during a time until the total of (3) amount increase in acceleration integration shown in FIG. 2 is below (6) amount increase in acceleration inhibition determining value and the influence by the fuel amount increase runs out (during (5) amount increase in acceleration inhibiting time t5 shown in FIG. 2).

Accordingly, even if the acceleration and deceleration operation D is continuously executed within (5) amount increase in acceleration inhibiting time t5 in (2) air fuel ratio is in rich state shown in FIG. 2, the amount increase in acceleration (a port shown by a dotted line in the item (1) amount increase in acceleration in FIG. 2) is not executed, the fuel more than request is not supplied from the fuel injection valve 7 shown in FIG. 1, (2) air fuel ratio does not become rich as shown in FIG. 2, and it is possible to effectively prevent the troubles such as the black smoke generation, the internal combustion engine stop and the like from being generated.

In this case, the fuel increase is not executed accompanying with the acceleration and deceleration operation D, however, since the fuel more than request is supplied in this period, an uncomfortable feeling is not generated even if the amount of fuel is not increased in correspondence to the acceleration operation.

Next, when the acceleration and deceleration operation E is executed, (4) total of amount increase in acceleration integration becomes below (3) amount increase in acceleration inhibition determining value on the basis of an elapse of (5) amount increase in acceleration inhibiting time t5, and the influence by the fuel amount increase runs out, as shown in FIG. 2. Accordingly, the conventional fuel amount increase control is executed.

What is claimed is:

1. A fuel supply control method of an internal combustion chamber for increasing an amount of a fuel for acceleration so as to inject from an injection apparatus, at a time when an electronic control unit detects a transient state at an accelerating time on the basis of engine operating data, wherein the method comprises a step of inhibiting said fuel amount increase for acceleration on the basis of the detection of the transient state, if the total amount of an injection fuel per a unit time is more than a fixed value.

2. A fuel supply control apparatus of an internal combustion engine comprising:

an electronic control unit sending a control signal to a fuel injection apparatus supplying a fuel to the internal combustion engine;

at least one sensor for detecting a transient state at an accelerating time; and the fuel supply control apparatus increasing an amount of the fuel at the accelerating time on the basis of a signal from said at least one sensor to supply the fuel from a fuel injection apparatus to the internal combustion engine, wherein said electronic control unit inhibits said fuel amount increase for acceleration from said fuel injection apparatus in the case that a total amount of the injection fuel per a unit time supplies to the internal combustion engine from said fuel injection apparatus is more than a fixed value.

3. A fuel supply control method of an internal combustion chamber for increasing an amount of fuel for acceleration so as to inject from an injection apparatus, at a time when an electronic control unit detects a transient state at an accelerating time on the basis of engine operating data, the method comprising the steps of:

providing a series of acceleration/deceleration operations including a first acceleration/deceleration operation and a second acceleration/deceleration operation;

determining an acceleration/deceleration time from a deceleration operation time of the first acceleration/deceleration operation to an acceleration operation time of the second acceleration/deceleration operation, the acceleration/deceleration time commencing at a deceleration time of the first acceleration/deceleration operation and terminating at an acceleration operation time of the second acceleration/deceleration operation;

determining a monitoring time which is required for an increased amount of fuel to be consumed in the internal combustion chamber;

if the acceleration/deceleration time is more than the monitoring time, then supplying to the internal combustion chamber the increased amount of fuel in correspondence to a detection of the first acceleration/ deceleration operation for the second acceleration/deceleration operation; and if the acceleration/deceleration time is less than the monitoring time, then inhibiting any increased amount of fuel to the internal combustion chamber for the second acceleration/deceleration operation.

* * * * *